US005195587A

United States Patent [19]

Webb

[11] Patent Number: 5,195,587

[45] Date of Patent: Mar. 23, 1993

[54] VAPOR RECOVERY SYSTEM

[75] Inventor: Willis G. Webb, Midland, Tex.

[73] Assignee: Conoco Inc., Ponca City, Okla.

[21] Appl. No.: 846,372

[22] Filed: Mar. 4, 1992

[51] Int. Cl.[5] ..... E21B 43/40; E21B 44/00; E21B 47/06

[52] U.S. Cl. ..... 166/252; 137/172; 137/173; 166/250; 166/267; 166/268; 166/53; 166/75.1; 210/143; 210/188; 210/258; 210/521; 210/539

[58] Field of Search ..... 166/53, 66, 75.1, 90, 166/91, 250, 252, 266, 267, 268; 210/137, 143, 188, 258, 521, 536, 537, 539, 540, 741, 800; 137/172, 173

[56] References Cited

U.S. PATENT DOCUMENTS 1,652,171 12/1927 Huff ..... 137/173 X
3,202,167 8/1965 Young et al. ..... 137/173
3,913,673 10/1975 Barber ..... 166/266
3,982,589 9/1976 Wilson et al. ..... 166/53
4,505,333 3/1985 Ricks, Sr. ..... 166/53 X
4,690,755 9/1987 Friedman et al. ..... 210/258 X
4,730,634 3/1988 Russell ..... 137/173 X
4,741,397 5/1988 Weeks ..... 166/53 X
5,032,260 7/1991 Alzner ..... 210/137
5,073,258 12/1991 Boullain, II et al. ..... 210/258 X

*Primary Examiner*—George A. Suchfield
*Attorney, Agent, or Firm*—John E. Holder

[57] ABSTRACT

In an oilfield production system, a water driven jet pump is used to evacuate vapors from storage tanks to thereby recover the vapors and prevent emissions from passing to the atmosphere. The jet pump entrains the vapors in process water which is passed to a process separator already in the system. The gas is separated for recovery.

14 Claims, 1 Drawing Sheet

VAPOR RECOVERY SYSTEM

This invention relates to a vapor recovery system and more particularly to a vapor recovery system for recovering vapors from storage tanks housing liquids containing some gaseous vapors.

This system was developed for use in an oil field production facility and would likely have use in other hydrocarbon process facilities having similar system characteristics as will be further discussed herein.

It is well known that storage tanks used for storing process liquids in oil field operations develop gaseous vapors in the upper portions of such tanks as gases come out of solution in process liquids. If these vapors occur in sufficient quantity to economically justify their recovery, it is often expedient to collect the vapors, pressurize them and pass them into a so called sales line for commercial disposal. On the other hand if such sales lines are not readily available or if the gases do not occur in sufficient quantity, it has been common in the past to vent such vapors to the atmosphere or to burn them in a flare.

More recently, with the advent of the Clean Air Act coupled with more rigid state and local air quality standards, some of these previous disposal methods are no longer viable. Past methods of vapor recovery on oilfield leases in particular have focused on commercial rather than environmental concerns. New air quality standards are expected to significantly increase the demand for systems that find ways to avoid disposing of storage tank vapors into the atmosphere either by direct venting or flaring. Tighter emission standards will demand better disposal systems which heretofore have been quiet costly. For some oilfield lease operators, the difference between shutting down a lease and keeping it pumping will depend on how economically vapor emissions can be controlled. In this regard a currently available system which is designed to decrease the cost of emission control involves a skid mounted gas collection and compression system for dealing with small amounts of gas from tanks in a typical production lease tank battery. However these systems require the use of a gas compressor which is relatively expensive to install and operate. For leases that are economically marginal, theses additional expenses may mean the economic end of some lease operations. These vapor recovery compressor units may require as many as four motors, one for running the compressor, one to pump lubricating oil into the compressor, one to operate a cooling system, and sometimes one to pump recovered liquid. Maintenance on compressors is fairly high due to its mechanical characteristics involving precision moving parts, high pressures, etc. Operating costs which include electrical power and lubricating oil are also relatively high.

It is therefore an object of the present invention to provide a new and improved vapor recovery system that meets the requirements of the Clean Air Act, which requires low capital expenditures, and has low maintenance and operating costs.

SUMMARY OF THE INVENTION

With these and other objects in view the present invention contemplates a system for collecting vapors from one or more vessels and feeding such vapors to a common line for recovery or disposal. A vapor detection device senses that vapors have reached a certain pressure level within the collection system and in response to such detection operates a valve to provide a supply of process fluids under pressure to a jet pump to act as a motive fluid for operating the jet pump. The collected vapors pass into a suction inlet on the jet pump and are then entrained into the process fluids driving the jet pump.

In a hydrocarbon production setting the gas entrained process fluids are recycled to a separator for initially separating production fluids before they are sent to the vessels from which the vapors are being taken. In such an oil field production system the process fluid will most likely be water under pressure from a water flood system or water being pumped from a water storage tank, with the pump being operated by the vapor detection device. If the process fluid is water, the gas entrained water may be disposed of such as by injection into underground formations.

DETAILED DESCRIPTION OF THE DRAWINGS

Figure 1:
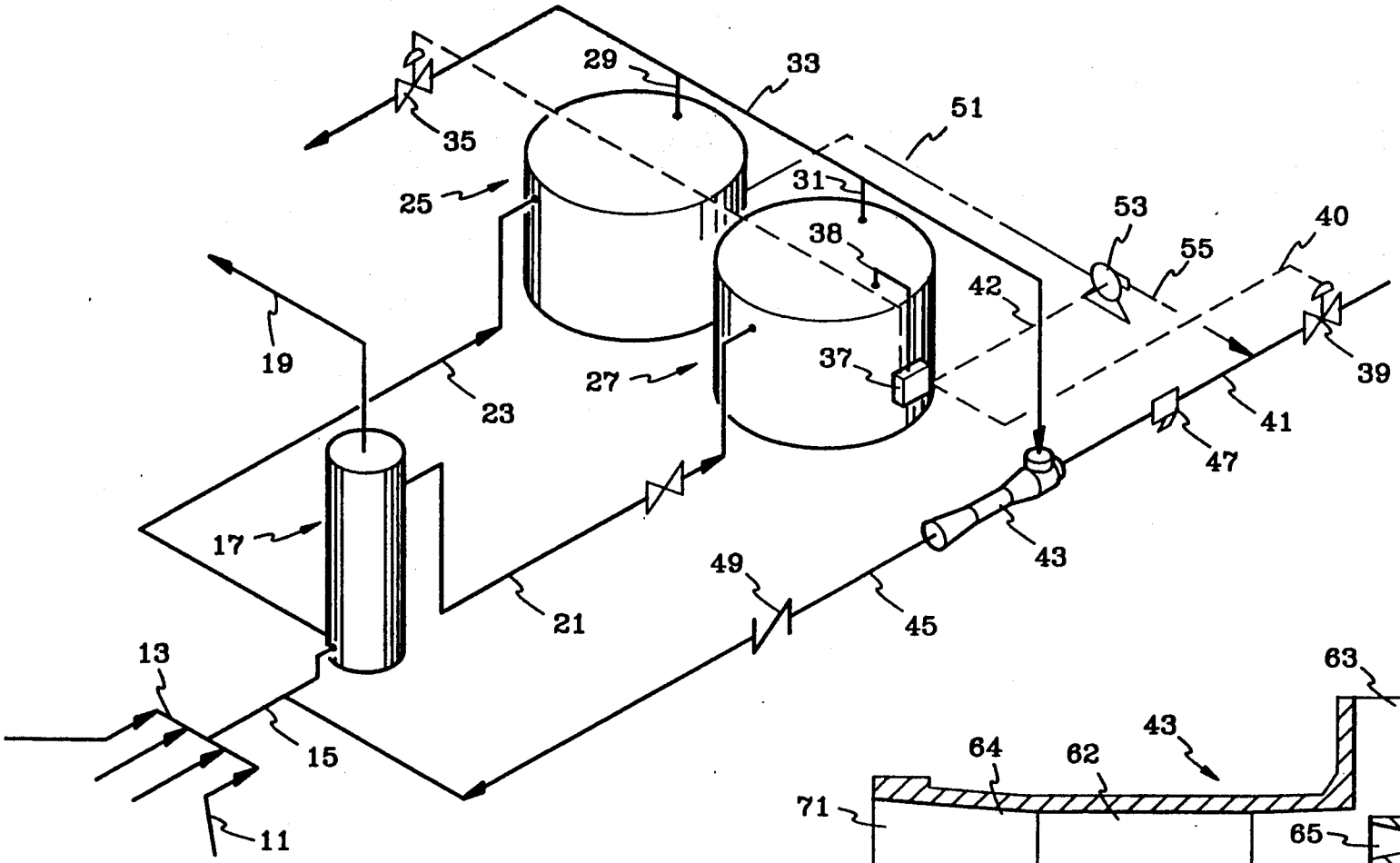
FIG. 1 is a perspective view of portions of an oil field production facility showing the present invention.

Referring first to FIG. 1 a production lease includes flowlines 11 which extend from wells (not shown) to the process facility for bringing produced fluids from the wells on the lease to the facility. The produced fluids from the wells are fed into a manifold 13 from which they are transferred by a line 15 to a primary separation device 17. There are any number of separation schemes which would be used at this point in a production separation process, with most schemes being more complex than a single separation vessel. However for purposes of illustration the single vessel shown in FIG. 1 is intended to represent such a function in the scheme of this invention. The ultimate purpose of such separation systems is to usually remove most of the free gas from the production stream and to separate oil and water in the production stream. Sufficient pressure is usually maintained in the effluent from the separator to move these fluids to storage tanks. The effluent streams from the separator 17 could of course be pumped to the tanks. FIG. 1 shows an oil leg from the separator passing oil by way of flowline 21 to oil storage tank 27. Likewise a water leg is passed through flowline 23 to water storage tank 25. Of course it is common that a larger number of tanks are involved in such a facility than shown in FIG. 1 and that water tanks may predominate because of a predominance of water in the production stream. Gas is shown being taken from the separator 17 by means of line 19 for disposal to sales or the like.

Vent lines 29 and 31 are shown rising from the top of water tank 25 and oil tank 27 respectively. These vent lines connect to a common vapor gathering line 33. One end of line 33 is shown connecting to a motor valve 35 which would control output to a flare or otherwise provide for emergency disposal in the present system. The other end of vapor gathering line 33 connects with jet pump or ejector 43.

Ejector 43 is supplied with a motive fluid by means of flowline 41 which in turn is connected to a supply of pressured fluid such as process water. A typical scheme in such a production lease would use waterflood process water under a system pressure of say 200 psi to act as the motive fluid to operate the pump 43. A motor valve 39 is shown positioned in line 41 which would supply this water under pressure. A vapor detection and control device 37 is shown connected by means of a line 38 to a vapor space in one of the tanks in order to detect the common vapor pressure of the system, since the line 33 is at a common pressure with vapors in all the tanks. When the vapor pressure in this common system reaches a certain level, a switch in the control system is activated which in turn sends electrical power or a control signal to motor valve 39. Dotted line 40 represents a path for the control signal. In the present example this control device was an apparatus sold by UMC Automation of Midland Texas termed "Vapor Recovery Control, E-Z Controller".

An alternative water supply source is shown as flowline 51 (dotted line) from the water tank 25 to provide a source of water to pump 53 which in turn would supply pressured water through pump output line 55 to line 41 and thus to ejector 43. Dotted line 42 represents a path for the control signal from control device 37 to operate pump 53.

A suction strainer 47 is provided upstream of the pump 43 for cleaning debris from the line. A check valve 49 is shown in the discharge line 45 from ejector 43 to isolate the vapor system in line 33 when the pump 43 is not being operated. Line 45 passes the fluids emerging from pump 43 back to the inlet line 15 to the separator 17.

Figure 2:
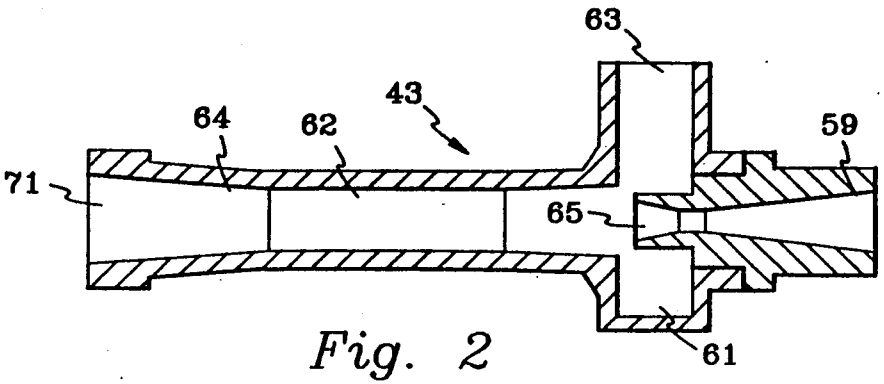
FIG. 2 is a cross sectional view of a jet pump for use the present invention.

Referring to FIG. 2, the jet pump or ejector 43 is shown having an inlet 59 which passes motive fluid through a nozzle 65 into a suction chamber 61.

Suction chamber 61 is connected with a suction inlet 63. Motive fluid passes through chamber 61 into a parallel section 62 and then into a diffuser section 64 which outlets fluids from the pump through outlet 71.

In the operation of such an ejector, the pumping or motive fluid enters an inlet 59 and passes through a venturi nozzle 65 which is centered in the flowstream. As it passes through the venturi nozzle, a suction is developed that causes fluids in the suction chamber 61 to be entrained into the pumping fluid. The suction inlet delivers fluid to be pumped to the suction chamber 61. In the present case, gas vapors are supplied by means of line 33 to the suction inlet where such vapors are delivered to the suction chamber 61 for entrainment into the motive stream which is water in this example.

The performance of an ejector is a function of the area of the motive fluid nozzle and venturi throat, pressure of motive fluid, suction and discharge pressures, as well as physical characteristics of the fluids involved. In the present example a Penberthy Jet Pump Model 1½ ELL Exhauster was used satisfactorily using pumping water supplied at 200 psi. These jet pumps operate on the principle of a operating fluid entraining a second fluid. The operating fluid (water in this instance) under pressure enters the inlet and travels through the nozzle into the suction chamber. The nozzle converts the pressure of the operating medium into a high velocity stream which passes from the discharge side of the inlet nozzle. Pumping action begins when vapors in the suction chamber are entrained by the high velocity stream emerging from the nozzle, lowering the pressure in the suction chamber. This causes the vapor in the suction chamber to flow toward the discharge thus mixing or entraining the material in the suction chamber with the operating fluid when it acquires the energy of the operating fluid in the parallel section. In the diffuser section, part of the velocity of the mixture is converted to a pressure greater than the suction pressure but lower than the operating medium pressure. In the present example, this exit pressure is approximately 20 psi.

In the operation of the system described in FIGS. 1 and 2, production fluids are collected from a number of producing wells through production flowlines 11 where they are then merged in manifold 13 and passed into a separator 17. This separator is typically a three phase system that liberates gas from the production fluids for disposal to gas sales by means of line 19. Oil and water streams from separator 17 are passed to storage tank 27 and 25 respectively for further disposal. This water may be then utilized in a water flood operation as the motive fluid. Alternatively the water may simply be reinjected into an underground formation for disposal or otherwise disposed of. The oil in storage tank 27 would normally be passed to sales such as by pipeline or trucking. The oil and water components of the produced fluids in tanks 25, 27 have gases in solution which will come out of solution in the storage tanks and collect at the top of the tanks. These hydrocarbon vapors ca contain toxic substances and therefore it may be hazardous to simply vent these vapors to the atmosphere. Flaring theses gases may likewise be environmentally undesirable. In the present system these vapors are passed by vent lines 29, 31 at the tops of tanks 25, 27; into vapor collection line 33 which is at a substantially common pressure with the vapor pressure in each of the tanks. This common vent line 33 communicates these vapors with the suction inlet 63 on the ejector 43. When the vapor pressure in the tanks and collection line reaches a certain predetermined level, this predetermined pressure level is communicated by line 38 to the vapor recovery control 37 where it causes activation of control valve 39 or pump 53 to provide a supply of motive fluid to the ejector 43. This passage of motive fluid under pressure through ejector 43 causes entrainment of vapors from line 33 into the motive fluid, which is water in this instance. This water and entrained gas is recycled to separator 17 where it again is separated into its constituent phases. Some of the entrained gases will be passed through line 19 to gas sales and typically some of the entrained vapors (gas) will pass in solution with the water and oil components of the fluid mixture passing through the separator. Some of these gas vapors will then pass back to the storage tanks where again they will pass through the process cycle just described. In this way a portion of the vapors from the tanks will pass to gas sales to provide for economic recovery of these gas components. An alternative flow scheme is characterized by passing the gas entrained water from the ejector into a reinjection system for injecting these fluids into an underground formation.

The low cost associated with the jet ejector system just described will now make it possible to economically deal with the vapor emissions which are associated with such petroleum production operations.

While this invention has been described in relation to a particular petroleum production scheme, it is appreciated that there may be many industrial applications where fugitive vapors are in need of safe disposal and where costs of dealing with the situation are prohibitive.

Therefore while particular embodiments of the present invention have been shown and described, it is apparent that changes and modifications may be made without departing from this invention in its broader aspects, and therefore, the aim in the appended claims is to cover all such changes and modifications as fall within the true spirit and scope of the invention.

We claim:

1. In an oil field production facility for collecting hydrocarbon fluids being produced from wells into a facility at the surface wherein produced fluids are initially passed into a production separator where the production fluids are separated into component streams comprised of oil, gas and water for sale or disposal, with the oil and water components being passed into separate storage tanks to await further processing and a gas collection line for passing gas separated from the production fluids, a system for collecting gas vapors from the storage tanks in the facility, comprising;

vent means on each of the tanks in the system;

common flowline means in fluid communication with each of said vent means for venting fluids from said tank;

water flowline means for providing a flow of water under pressure;

fluid operated jet pump means located in said water flowline and arranged so that said jet pump is operated by the flow of water in said water flowline, said jet pump having a suction inlet for pulling vented fluids into said pump for entrainment into and discharge with the water flowing through said pump; and means for providing a fluid communication path between said suction inlet and said common flowline to permit vented fluids to pass into said jet pump suction inlet.

2. The vapor collection system of claim 1 and further including:

means for selectively controlling fluid flow through at least a portion of said water flowline means wherein said jet pump is located;

pressure sensing means for determining the vapor pressure of fluids on one of said storage tanks; and control means responsive to pressure sensed by said pressure sensing means for operating said controlling means 3. The vapor recovery system of claim 2 wherein said production facility has water under pressure from existing facility processes for supplying water under pressure to said water flowline means and further wherein said selectively controlling means is a motor valve in said water flowline means operable in response to said control means.

4. The Vapor recovery system of claim 1 and further including means for passing water discharged from said jet pump with gas entrained therein to the production separator in said field production facility from which oil and water components are passed into said storage tanks.

5. The vapor recovery system of claim 1 and further including water supply means for supplying water passed through the production separator in said facility, and pump means positioned in said water flowline for pumping water from said water supply means into said jet pump to supply water under pressure to said water flowline and thereby provide motive power to operate said jet pump.

6. The vapor recovery system of claim 1 wherein the wells for producing hydrocarbon fluids are being produced by a waterflood recovery system where water under pressure is injected into the wells to sweep hydrocarbons from underground reservoirs and further wherein water from a portion of the waterflood recovery system is supplied to said water flowline under pressure, and further including motor operated valve means in said water flowline;

pressure sensing means for detecting the pressure of fluids in at least one of said tanks; and control means operable in response to said pressure sensing means for operating said motor operated valve means.

7. The vapor recovery system of claim 1 and further including check valve means in said water flowline downstream of said jet pump means to prevent fluids in said water flowline downstream of said check valve from moving into said common flowline means.

8. The vapor recovery system of claim 1 and further including means for passing said water with entrained gas into underground formations.

9. A vapor collection system for collecting gases which are being vented from a liquid storage tank in a hydrocarbon processing facility, comprising;

tank vent means for passing vapors from said liquid storage tank;

jet pump means having a suction inlet connected to said tank vent means for communicating vapors from said tank to said suction inlet;

process fluids from said hydrocarbon processing facility for operating said jet pump;

selectively operable means for providing said process fluids under pressure to said jet pump to selectively operate said jet pump; and sensing means for sensing a discrete level of vapor pressure in said tank and for activating said selectively operable means in response to said sensing of said discrete level of vapor pressure.

10. A method for recovering vapors from liquid storage tanks in a hydrocarbon fluids processing facility including the steps of supplying a hydrocarbon fluids and water mixture to a fluid separation device;

separating liquid components of the mixture into predominately water and oil streams;

passing the water and oil streams to separate storage tanks;

venting gases from the storage tanks using a common vent line;

communicating the vent line with the suction inlet of a jet pump;

supplying process fluid under pressure from the process facility to the jet pump for supplying motive fluid to operate the jet pump;

entraining vented gases from the tanks into the process fluid operating the jet pump; and passing said process fluid with entrained vented gases from said jet pump.

11. The method of claim 10 wherein said process fluid is predominately water from one of said storage tanks.

12. The method of claim 10 wherein said process fluid with entrained water is passed from said jet pump to said separator.

13. The method of claim 10 wherein the fluids processing facility is an oil well production facility where a water stream is injected into underground formations to produce hydrocarbon fluids from the formations and further including passing said process fluid with entrained gas emanating from said jet pump into said water stream.

14. The method of claim 10 and further including passing said process fluid with entrained gas emanating from said jet pump into underground formations.

* * * * *